US008857030B2

(12) United States Patent
Stutson, Jr.

(10) Patent No.: US 8,857,030 B2
(45) Date of Patent: Oct. 14, 2014

(54) LEVERAGE TOOL FOR OPENING CARGO CONTAINERS

(76) Inventor: Joseph H. Stutson, Jr., Jefferson, LA (US)

( * ) Notice: Subject to any disclaimer, the term of this patent is extended or adjusted under 35 U.S.C. 154(b) by 196 days.

(21) Appl. No.: 13/428,940

(22) Filed: Mar. 23, 2012

(65) Prior Publication Data

US 2013/0247351 A1 Sep. 26, 2013

(51) Int. Cl.
*B66F 15/00* (2006.01)

(52) U.S. Cl.
USPC ..... 29/426.5; 29/240; 29/244; 29/426.1; 81/15.9; 81/484; 254/131; 254/131.5

(58) Field of Classification Search
USPC ..... 29/426.5, 426.1, 244, 240; 81/15.9, 81/484, 488; 254/21, 25, 19, 131, 131.5, 254/26 R, 26 E; 269/3, 6, 95
See application file for complete search history.

(56) References Cited

U.S. PATENT DOCUMENTS

| | | | | |
|---|---|---|---|---|
| 605,730 | A * | 6/1898 | Leyendecker | 29/267 |
| 1,345,027 | A * | 6/1920 | Rippe | 81/484 |
| 2,688,266 | A * | 9/1954 | Knudsen et al. | 81/15.9 |
| 3,657,944 | A | 4/1972 | Able | |
| 3,843,981 | A | 10/1974 | Verest | |
| 5,425,154 | A | 6/1995 | Edwards, Jr. | |
| 5,481,950 | A * | 1/1996 | Browning | 81/488 |
| 5,713,614 | A | 2/1998 | Anderson | |
| 6,199,456 | B1 * | 3/2001 | Hlady | 81/177.2 |
| 6,502,483 | B1 * | 1/2003 | Swank et al. | 81/437 |
| 6,920,807 | B2 * | 7/2005 | Bond | 81/45 |
| 7,389,971 | B2 * | 6/2008 | Gaudreault et al. | 254/243 |
| 2007/0096473 | A1 * | 5/2007 | Ortega | 292/1 |
| 2008/0012356 | A1 * | 1/2008 | Lugo | 292/218 |
| 2008/0217592 | A1 * | 9/2008 | Chambers | 254/25 |
| 2009/0108244 | A1 | 4/2009 | Reidling | |
| 2010/0115705 | A1 * | 5/2010 | Allen et al. | 7/166 |
| 2011/0113566 | A1 * | 5/2011 | Holbrook | 7/146 |
| 2012/0073411 | A1 * | 3/2012 | Smith et al. | 81/488 |
| 2012/0216352 | A1 * | 8/2012 | Fisher et al. | 7/166 |
| 2012/0313060 | A1 * | 12/2012 | Weinreich | 254/131 |
| 2013/0086845 | A1 * | 4/2013 | High | 49/506 |
| 2013/0263382 | A1 * | 10/2013 | Sindt et al. | 7/166 |
| 2014/0103275 | A1 * | 4/2014 | Chen | 254/26 R |
| 2014/0123814 | A1 * | 5/2014 | Vigil | 81/15.9 |

* cited by examiner

*Primary Examiner* — Essama Omgba
*Assistant Examiner* — Darrell C Ford
(74) *Attorney, Agent, or Firm* — Keaty Law Firm, LLC

(57) ABSTRACT

A leverage hand tool for opening doors of a conventional cargo container provided with a latch mechanism having locking brackets and pivotal levers engaged with the locking brackets. The leverage tool is designed to amplify the lever arm formed by the pivotal container handle and make it easier to release the arm from the locking bracket. The tool has an elongated tool handle with a longitudinal axis and an engaging member secured to the tool handle at an acute angle in relation to the longitudinal axis. The engaging member has a through opening of sufficient size to slide over a pivotal lever of the cargo container while transmitting pivotal force from the tool handle to the pivotal lever.

8 Claims, 5 Drawing Sheets

LEVERAGE TOOL FOR OPENING CARGO CONTAINERS

BACKGROUND OF THE INVENTION

This invention relates to a hand tool for opening a shipping container, and more particularly to a leverage tool for opening a cargo container.

Cargo containers are used for shipping freight on commercial transport carriers such as cargo ships, railcars and trailers. The cargo containers are made of metal according to the ISO (International Standards Organization) specifications which ensure that the containers are inter-operable with compatible carriers, or intermodal. One feature of the ISO container is a door that is locked with padlocks, called "high security seals" in the shipping industry. This lock has its bar passed through holes in two metal pieces on the right door that hold down the door handle and prevent the door from being opened.

To open a conventional cargo container door, the user needs to rotate the top piece that the lock passed through upwards (it is attached on a bearing) to provide a space for the door lever. Then, the user needs to hold the rotating piece up while pulling the door lever up until it is clear of the fixed lower piece of the locking mechanism. The door lever is then pulled toward the user until it is at a 90-degree angle to the door surface. The rotating piece of the locking mechanism is then released and allowed to fall back into place. Moving the door lever toward the user pulls in the door's locking pins, located at the top and the bottom of the right door. Ideally, it should move freely once they are pulled in, and allow the left door to be opened. The left door may also have manual pins holding it to the top and bottom of the container. These pins need to be pulled out of their slots and twisted sideways to keep them raised and lowered. This will allow the door to move freely.

While this process appears to be relatively simple, the reality is such that the door levers are often rusted and require considerable strength to pull and pivot.

The present invention contemplates provision of a hand tool that can be used for opening lever doors of cargo containers.

SUMMARY OF THE INVENTION

It is, therefore, an object of the present invention to provide a tool for opening cargo containers, such as intermodal shipping containers.

It is another object of the invention to provide a leverage tool for amplifying a lever arm for opening cargo containers having lever handles and other applications.

These and other objects of the invention are achieved through a provision of a tool for opening doors of a cargo container provided with a latch mechanism having locking brackets and pivotal levers engaged with the locking brackets. The tool has an elongated tool handle and an engaging member configured for engaging the pivotal arm of the cargo container. The engaging member has a tubular body secured to a proximate end of the tool handle an acute angle of about thirty-seven degrees.

The tubular body has a through opening of an oval cross section to facilitate application of the pivotal force to the lever handle of the C-container. A U-shaped cutout is formed in the tubular body to about one-half width/length of the tubular body to allow a portion of a free end of the pivot lever to extend when aligning the engaging member and positioning the engaging member over the lever handle.

BRIEF DESCRIPTION OF THE DRAWINGS

Reference will now be made to the drawings, wherein like parts are designated by like numerals, and wherein.

DETAIL DESCRIPTION OF THE INVENTION

Turning now to the drawings in more detail, numeral 10 designates the hand tool according to the present invention. The hand tool 10 comprises an engaging member 12 and an elongated tool handle 14 affixed to the engaging member 12. The engaging member 12 comprises a hollow generally tubular body having a through opening extending through entire length of the engaging member 12. The through opening formed in the engaging member has a sufficient size to allow the engaging member to slide over a lever of a cargo container, as will be described in more detail hereinafter.

Figure 13:
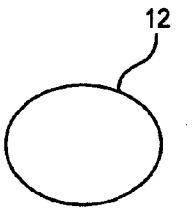
FIG. 13 is an end view of the engaging member of the tool.

The engaging member 12 comprises a first open end 16 and a second open end 18. The engaging member 12 has a generally oval cross section, as shown in FIG. 13. The engaging member 12 is provided with a U-shaped cutout 20 formed a distance from the first end 16 and the second end 18. The cutout 20 is defined by a first arcuate shoulder 22, a second arcuate shoulder 24 and a pair of opposing edges 26, 28 that extend substantially parallel to a longitudinal axis of the engaging member 12 and transversely to the arcuate shoulders 22, 24. In one aspect of the invention, the cutout 20 extends to about one-half diameter of the tubular body forming the engaging member 12.

Figure 3:
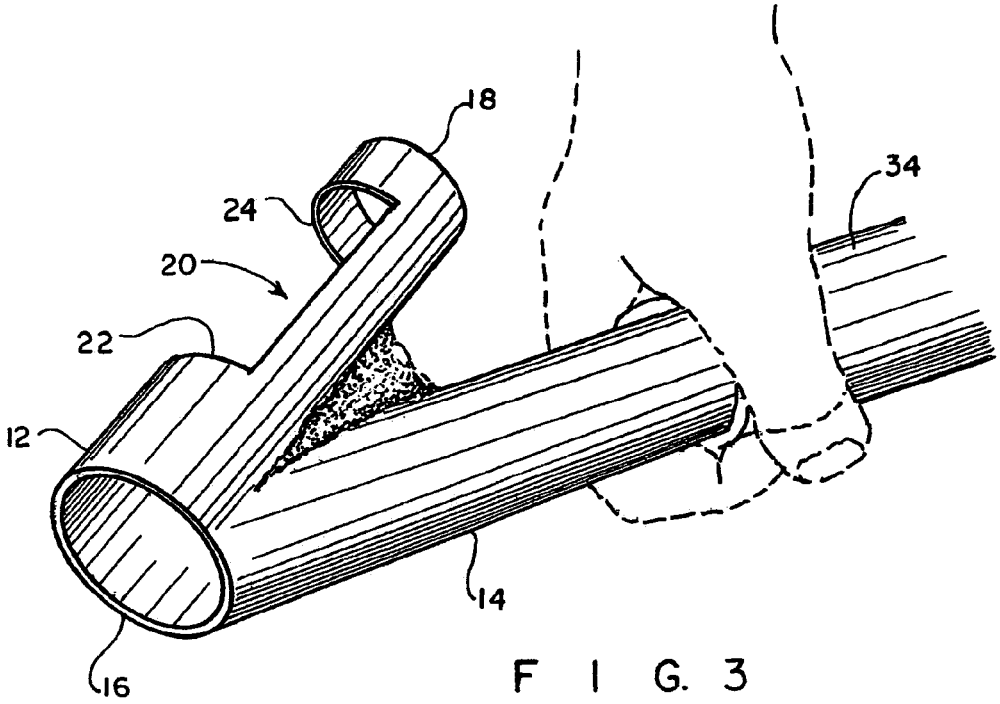
FIG. 3 is a detail perspective view of the proximate end of the tool of the present invention.
Figure 4:
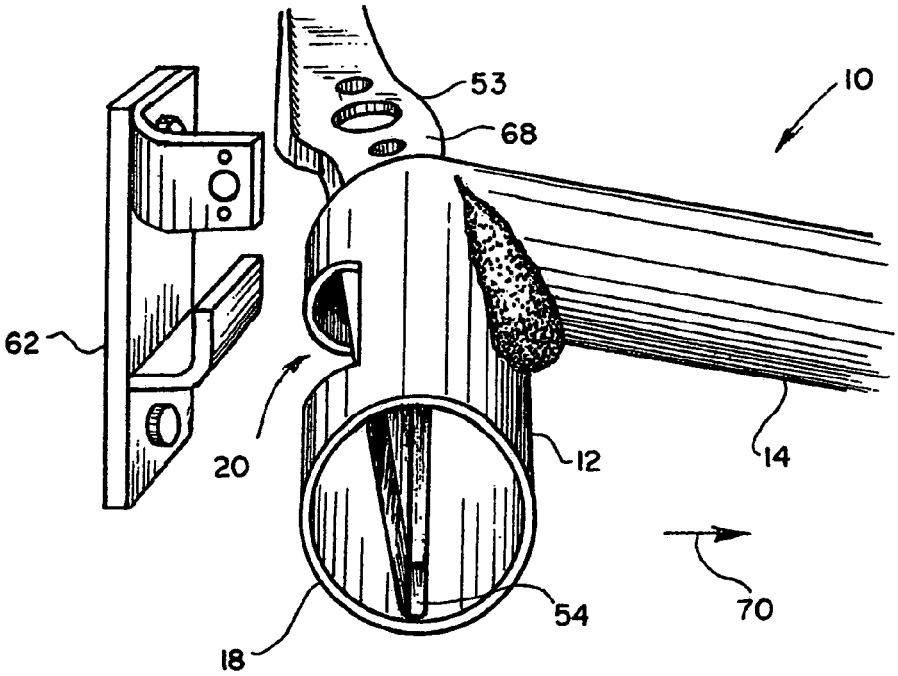
FIG. 4 illustrates engagement of a container door handle using the tool of the present invention.

In one aspect of the invention, the engaging member 12 is about 4-5 inches long, while the oval is about 1-1.5 inches long and about 0.9-1.1 inches wide. The cutout 22 can be formed to about one-half cross-sectional width of the engaging member 12, and the distance between the arcuate shoulders 22 and 24 can be about 2-3 inches. It will be understood that the above dimensions are exemplary and other dimensions can be employed when manufacturing the engaging member 12. For instance, the orientation of the oval engaging member 12 can be changed such that it is oriented vertically, that is the cutout is formed in its cross-sectional length rather than its cross-sectional width, as for instance shown in FIG. 3.

Figure 9:
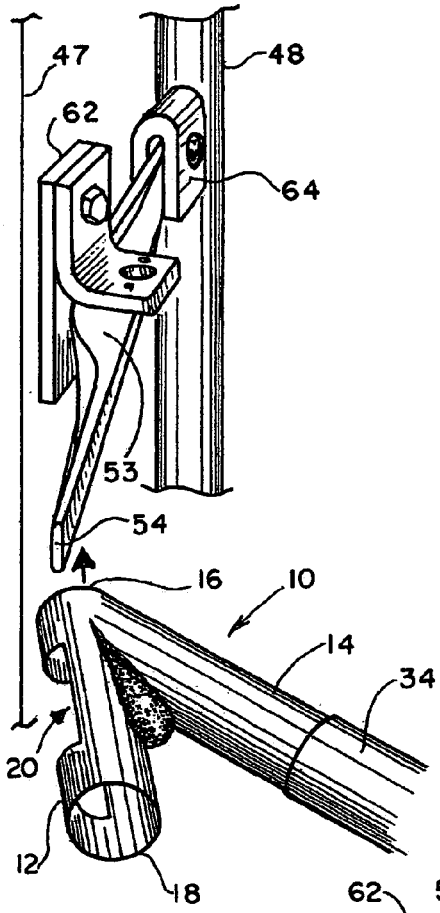
FIG. 9 illustrates angular positioning of the tool in proximity to a door handle of a cargo container in a case where the door handle's tip is too close to an adjacent latching rod.

The tool handle 14 can be attached to the engaging member by welding or other suitable mechanical means. As can be seen in FIG. 9, the engaging member 12 is oriented at an acute angle of about 37 degrees in relation to a longitudinal axis of the tool handle 14 that is an imaginary central axis of the engaging member is oriented at about thirty-seven degrees in relation to the longitudinal axis of the tool handle 14.

The tool handle 14 comprises a proximate end 30 and a distant end 32. An angled cut is formed in the proximate end 30 to secure the engaging member and the tool handle 14 together. The line of attachment of the engaging member 12 to the tool handle 14 starts adjacent the first end 16 of the engaging member 12. In one aspect of the invention the line of attachment starts at a point "b" at about 0.025-0.3 inches from the first end 16.

In one aspect of the invention, the tool handle is formed as a cylindrical body, which can be tubular and formed from a metal pipe stock. The tool handle can be about 36-40 inches long and about 1 inch thick. If desired a protective sleeve 34 can be positioned on the tool handle 14. The sleeve 34 can be made of pliable material, such as plastic to make it more comfortable for the user to grip the tool handle 14 during use. The sleeve 34 may or may not encase the entire tool handle 14. The drawings illustrate the sleeve 34 being somewhat less in length than the tool handle 14.

Figure 1:
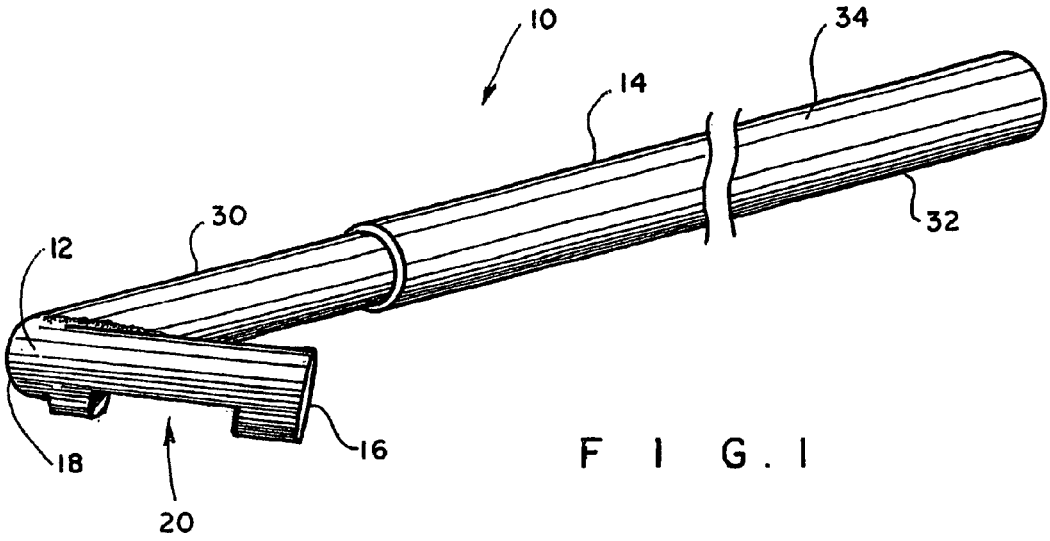
FIG. 1 is a perspective view of the hand tool according to the present invention.
Figure 2:
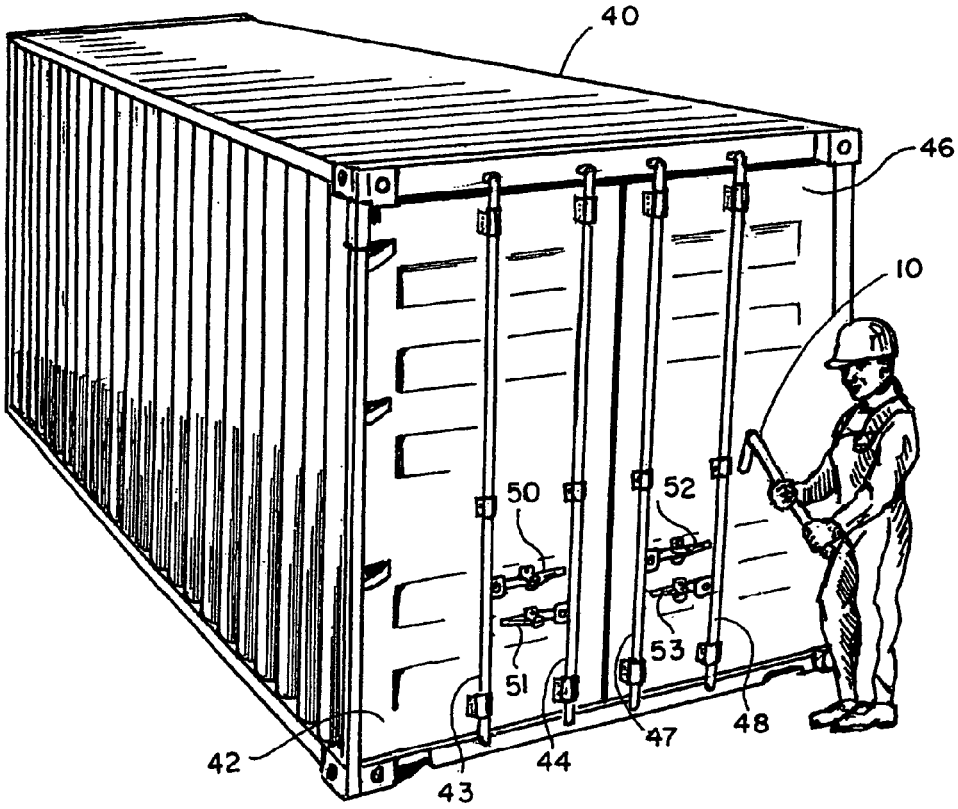
FIG. 2 is illustrates an intermodal cargo container with lever handles and the tool of the present invention applied thereto.

Referring to FIG. 2, there is illustrated a cargo container 40, which is a conventional ISO container. The container 40 includes left and right container doors 42 and 46 secured in a closed position by a set of vertically disposed rotating rods 43, 44 and 47, 48. Usually two rotating rods are provided for each door 42, 46. The rotating rods 43, 44 and 47, 48 function as locking bars locking and releasing locking cams (not shown) at the top and bottom of the locking bars when the locking bars are rotated by a lever or handle 50, 51, 52, and 53.

A portion of a container door 46 and the door latch assembly 60 of the cargo container 40 is shown in detail in FIGS. 5-11. The door latch assembly 60 includes the rotating latching rod 48, the lever 53, and a locking bracket 62 of the lever 53. Conventionally, the lever 53 is secured to the rod 48 by a pivotal bracket 64. When the door 46 is locked the lever 53 extends generally parallel to the door 46 and a right angle to the latching rod 48.

Figure 5:
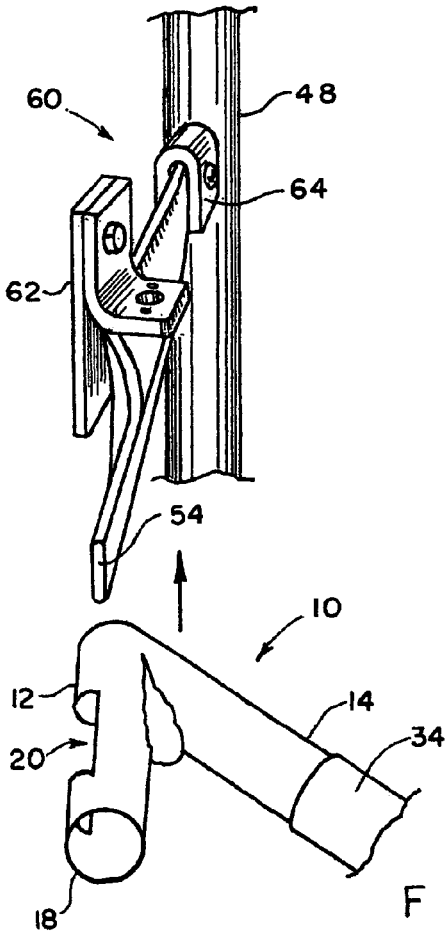
FIG. 5 illustrates a first step of engaging a lever handle of a cargo container.
Figure 6:
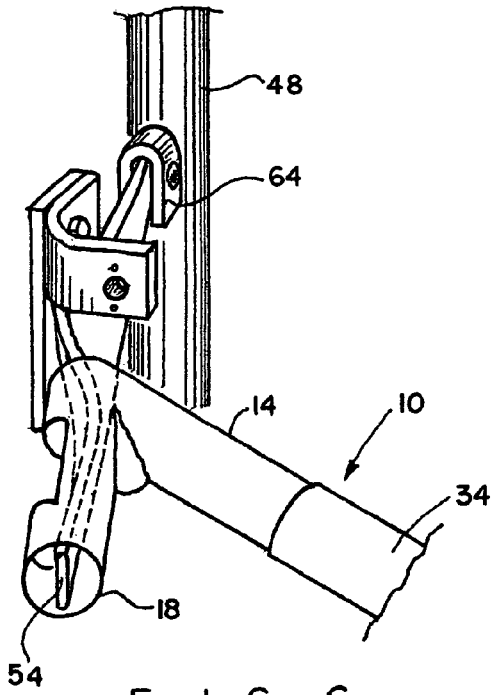
FIG. 6 illustrates a step full engagement of the lever handle by the tool of the present invention.
Figure 7:
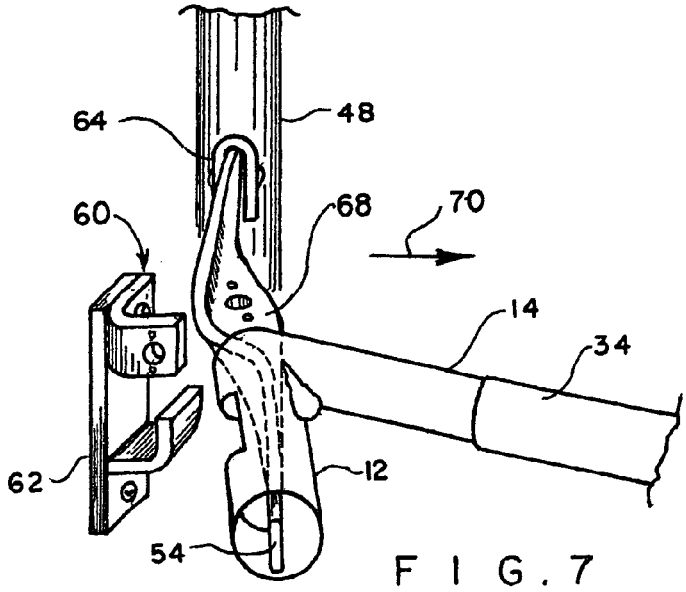
FIG. 7 illustrated the step of causing the lever handle to disengage from the latching assembly using the tool of the present invention.
Figure 10:
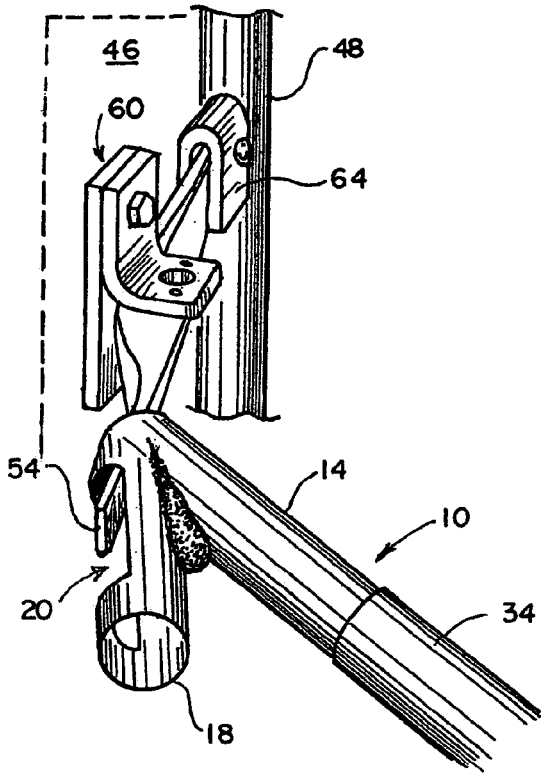
FIG. 10 illustrates partial extension of the door handle through a cutout in the engaging member.
Figure 11:
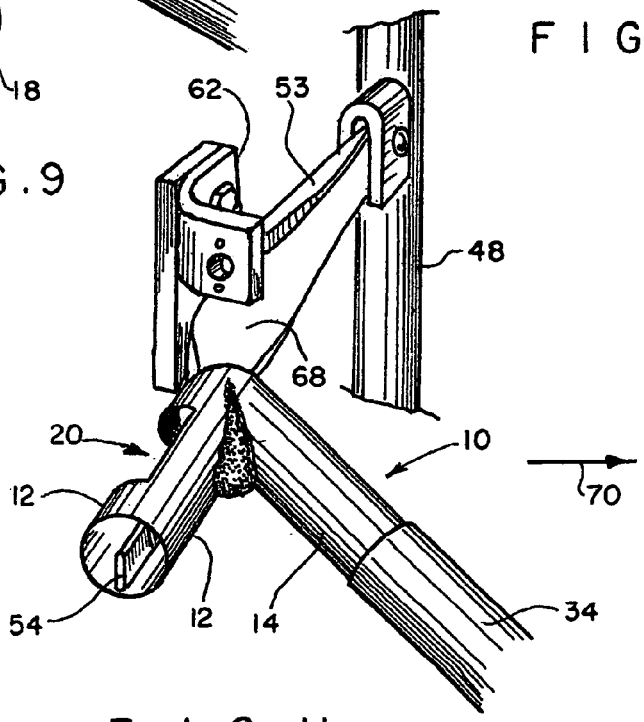
FIG. 11 illustrates positioning of the tool of the present invention on the cargo door handle in a substantially parallel relationship to the door of the cargo container.
Figure 12:
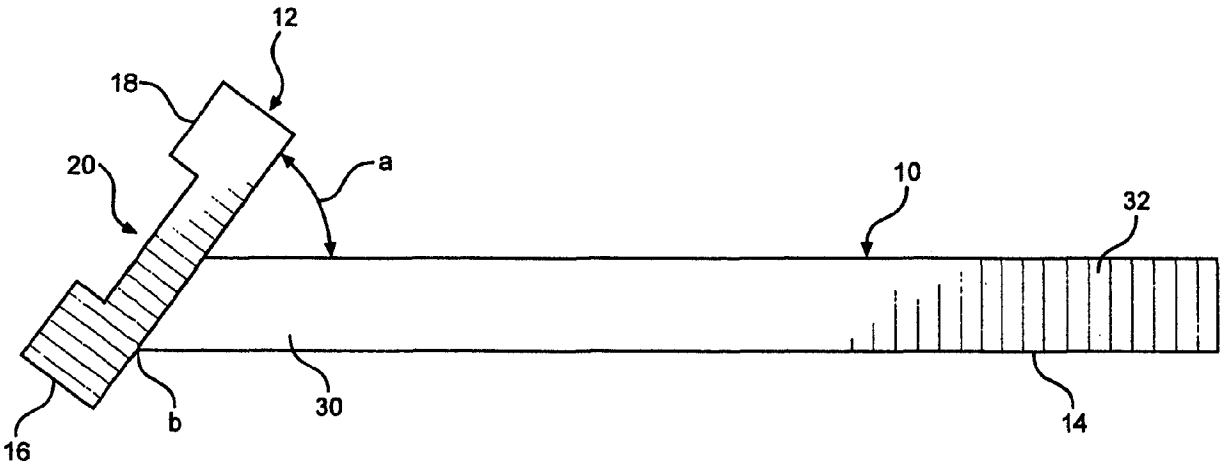
FIG. 12 is a plan view of the tool of the present invention.
Figure 14:
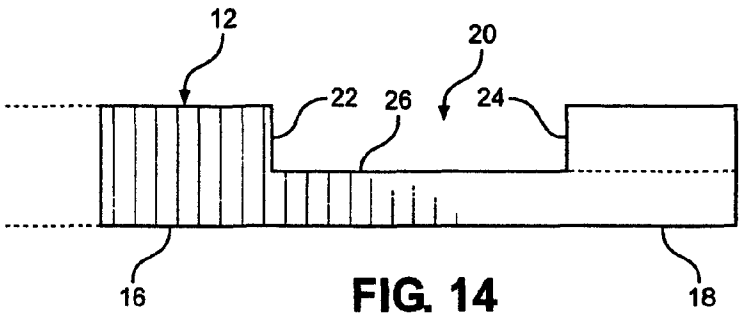
FIG. 14 is a plan view of the engaging member of the tool of the present invention.

Reference will now be made to FIGS. 5-11 illustrating operation of the tool of the present invention. In operation, the user moves the tool 10 to align the engaging member 12 with a free end 54 of the lever 53, while gripping the tool handle 14 (FIG. 5). The user slides the engaging member 12 over the lever 53 (FIG. 6). The first end 16 of the engaging member 12 abuts an enlarged width part 68 of the lever 53, as shown in FIGS. 7 and 11.

Figure 8:
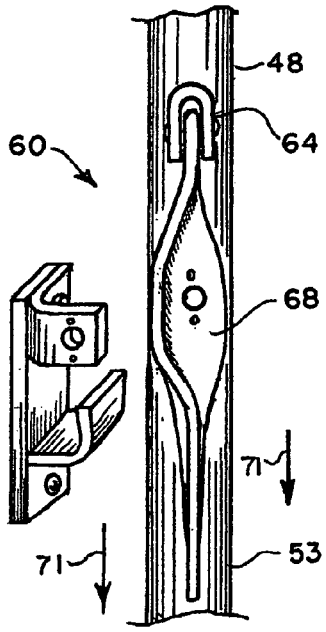
FIG. 8 illustrates a step of allowing the lever handle to pivot down fully disengaged from the latching assembly.

The user then pivots the handle 53 in the direction of arrow 70 shown in FIGS. 7 and 11 so that it extends away from the latch assembly 60 (FIG. 7). The oval cross section of the engaging member and the oval opening formed in the engaging member 12 facilitate application of torque to the lever 53. Once the lever 53 is released from engagement with the bracket 62, the user can lower the handle pivoting it in a downward direction as shown by arrow 71 (FIG. 8). The engaging member 12 is then disengaged from its surrounding relationship over the lever 53. The above steps are repeated for other lever handles of the cargo container 40.

Some containers 40 have latching rods 43, 44 and 47, 48 positioned very close to each other, such that the free end 54 of the lever 53 is positioned a small distance from the adjacent parallel latching rod on the same door. This situation is illustrated in FIGS. 9-11. In such case, the length of the engaging member 12 does not fit between the free end 54 and the adjacent latching rod 47. In such a case slightly different initials steps must be taken to ensure that the engaging member 12 is positioned in a surrounding relationship over at least a portion of the lever 53. The user aligns the end 16 of the engaging member 12 with the free end 54 of the lever 53 (FIG. 9). The user then moves the tool 10 such that it extends at an angle in relation to the lever 53 allowing the free end 54 to extend through the cutout 20 in the engaging member 12, as shown in FIG. 10. Once a sufficient part of the engaging member 12 is positioned over the free end 54 the user pivots the tool 10 such that the engaging member 12 extends parallel to the door 46 and over at least a portion of the lever handle 53, as shown in FIG. 11.

The steps of pivoting the lever 53 and releasing the lever 53 from the bracket 62 are then performed until the lever 53 is disengaged from the bracket 62. The tool 10 can then be withdrawn from the lever 53 and the steps described above repeated for all levers. Conventionally, the right door 46 of the cargo container 40 overlaps the left door 42. Therefore, the order of opening the levers of the cargo container 40 can start with the right door 46 and end with the left door 42.

The leverage tool of the present invention increases the lever arm of the container handles and makes it easier to move the pivotal container handles. The locking of the cargo container can be facilitated by using the tool 10 in moving the container levers into a locked position with their respective locking brackets. It is envisioned that the tool of this invention can be used for other situations, where an enhanced leverage force is required and longer lever arm is beneficial.

Many changes and modifications can be made in the design of the tool of the present invention without departing from the spirit thereof. I, therefore, pray that my rights to the present invention be limited only by the scope of the appended claims.

I claim:

1. A method of opening doors of a cargo container provided with a latch mechanism having locking brackets and pivotal levers engaged with the locking brackets, the method comprising the steps of:

providing a leverage tool comprising an elongated tool handle having a longitudinal axis and a proximate end and a distal end, and a tubular engaging member having a central axis, said engaging member comprising a tubular body having a first open end and a second open end, said engaging member being provided with a cutout formed a distance from the first open end and the second open end, said engaging member being secured to the proximate end of the tool handle such that the central axis of the engaging member extends at the acute angle in relation to the longitudinal axis of the tool handle and the engaging member extends such that the first open end projects toward the distal end of the elongate tool handle;

positioning the engaging member in alignment with the pivotal lever of the cargo container;

sliding the engaging member over the pivotal lever of the cargo container;

moving the engaging member toward the pivotal lever to cause a free end of the pivotal lever to extend from the first open end through said cutout; and applying pivotal force to the tool handle, thereby transmitting amplified pivotal force to the pivotal lever and releasing the pivotal lever from locking engagement with the locking bracket.

2. The method of claim 1, further comprising a step of realigning the engaging member such that the central axis of the engaging member extends substantially co-axially with the pivotal lever, and then sliding the engaging member over the pivotal lever so that the free end of the pivotal lever moves toward the second open end prior to releasing the pivotal lever from the locking bracket.

3. The method of claim 1, said cutout has a generally U-shaped configuration and is defined by a pair of spaced apart arcuate shoulders and a pair of parallel edges, which extend substantially parallel to the central axis of the engaging member.

4. The method of claim 1, said engaging member has a generally oval cross section of pre-determined cross-sectional length and a pre-determined cross-sectional width.

5. The method of claim 4, wherein said cutout extends to about one-half of said cross-sectional width.

6. The method of claim 4, wherein said cutout extends to about one-half of said cross-sectional length.

7. The method of claim 1, further comprising a sleeve secured on at least a portion of the tool handle.

8. The method of claim 1, wherein the central axis of the engaging member is oriented at about thirty-seven degrees in relation to the longitudinal axis of the tool handle.

* * * * *